US006402045B1

(12) United States Patent
Persson

(10) Patent No.: US 6,402,045 B1
(45) Date of Patent: Jun. 11, 2002

(54) METHOD OF GENERATING A LIQUID MIST

(75) Inventor: Rolf Persson, Ljungsbro (SE)

(73) Assignee: Totalförsvarets Forskningsinstitut, Stockholm (SE)

( * ) Notice: Subject to any disclaimer, the term of this patent is extended or adjusted under 35 U.S.C. 154(b) by 0 days.

(21) Appl. No.: 09/445,463

(22) PCT Filed: Jun. 18, 1998

(86) PCT No.: PCT/SE98/01198

§ 371 (c)(1),
(2), (4) Date: Dec. 20, 1999

(87) PCT Pub. No.: WO98/57847

PCT Pub. Date: Dec. 23, 1998

(30) Foreign Application Priority Data

Jun. 18, 1997 (SE) ..... 97023303

(51) Int. Cl.[7] ..... B05B 17/00

(52) U.S. Cl. ..... 239/1; 239/99; 239/101; 239/329; 239/452; 239/456

(58) Field of Search ..... 239/1, 328, 329, 239/331, 373, 452, 456, 459, 554, 570, 579, 99, 101, 21, 14.1, 211; 261/35; 40/427, 439, 407, 212; 472/65

(56) References Cited

U.S. PATENT DOCUMENTS 1,296,226 A * 3/1919 Stow
3,698,338 A * 10/1972 Hymowitz
4,204,715 A * 5/1980 Lavon
4,289,275 A * 9/1981 Lavon
4,406,815 A * 9/1983 Magnusson et al.
4,522,126 A * 6/1985 Bell
5,401,976 A * 3/1995 Bannasch
5,942,976 A * 8/1999 Wieser et al.
5,979,791 A * 11/1999 Kuykendal et al.
6,119,955 A * 9/2000 Starr
6,191,688 B1 * 2/2001 Sprouse

FOREIGN PATENT DOCUMENTS

| | | |
|---|---|---|
| DE | 32 17 336 | 3/1983 |
| DE | 37 06 781 | 9/1988 |
| DE | 44 17 484 | 12/1994 |
| EP | 0 221 469 | 5/1987 |

* cited by examiner

*Primary Examiner*—Henry C. Yuen
*Assistant Examiner*—Christopher S. Kim
(74) *Attorney, Agent, or Firm*—Jacobson Holman, PLLC

(57) ABSTRACT

A method for generating a liquid mist to produce phantom targets or camouflage. A liquid is launched by a water cannon (1) at high velocity and initially the liquid is held together in a liquid packet (2) in order to decompose after a certain distance, under the effect of the air resistance, and atomize into small liquid drops to form a liquid mist (3).

14 Claims, 2 Drawing Sheets

METHOD OF GENERATING A LIQUID MIST

BACKGROUND OF THE INVENTION

1. Field of the Invention

The present invention relates to a method of generating a liquid mist for producing phantom targets or camouflage.

2. Prior Art

It is previously known that a liquid mist, for example in the form of a water mist, can be used for camouflaging an object or for producing phantom targets, if an object is covered by a water mist, detection by means of IR measurement is rendered more difficult. By regulating the temperature of the water which is used for generating the mist it is also possible to generate a mist having a temperature which makes it an effective phantom target, for instance for an IR target seeker.

The patent document EP 0 221 489 B shows an example of a device for producing phantom targets and camouflage by generation of a liquid mist. With this device the mist is generated by means of water projectors provided with atomiser nozzles. The liquid is discharged through the nozzles in the shape of very small drops.

The known technique of generating a liquid mist by means of atomiser nozzles has several shortcomings, it takes a relatively long time to generate a completely covering mist, and therefore a long forewarning time is required in case of an attack from homing missiles. Furthermore, the water consumption is very high. In cold weather there is also a risk that the nozzles will be blocked up by ice and that the protected installation will be covered with ice.

SUMMARY OF THE INVENTION

The object of the invention is to produce a new technique of generating a liquid mist for producing camouflage or phantom targets, which overcomes the problems experienced with the previously known technique.

According to the invention, the liquid mist is generated by launching water, by means of a water cannon, at such a high velocity that initially the liquid is held together in a liquid packet in order to decompose after a certain distance, under the effect of the air resistance, and atomize into small liquid.

With the new technique, a shorter time delay is obtained between the initiation and the moment at which the liquid mist is fully developed. The water consumption is low, and therefore the technique is also suitable for use on mobile installations on land. As the formation of the mist takes place at a certain distance from the protected installation and the launching device has no atomizer nozzles, there will be less problems with ice formation than with the previously known technique. Furthermore, the launched liquid packet is relatively insensitive to the effects of wind, and therefore it will be easier to achieve the mist formation at a predetermined location in space.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE DRAWINGS

In the following, the invention will be further described by way of example with reference to the accompanying drawings, in which.

DESCRIPTION OF THE INVENTION

Figure 2:
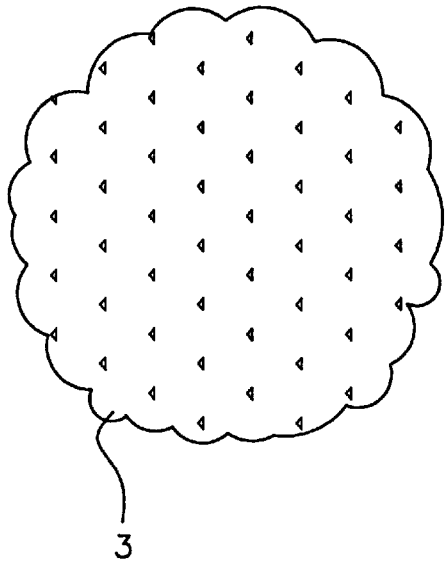
FIG. 2 shows a liquid packet which has decomposed and formed a mist.

Although only one preferred embodiment of the invention is explained in detail, it is to be understood that other embodiments are possible. Accordingly, it is not intended that the invention is to be limited in its scope to the details of construction and arrangement of components set forth in the following description or illustrated in the drawings. The invention is capable of other embodiments and of being practiced or carried out in various ways. Also, in describing the preferred embodiment, specific terminology will be resorted to for the sake of clarity. It is to be understood that each specific term includes all technical equivalents which operate in a similar manner to accomplish a similar purpose.

Figure 1:
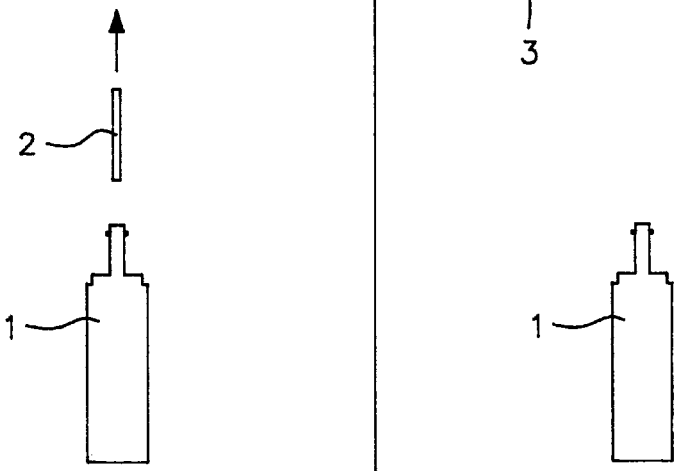
FIG. 1 shows a liquid packet which has been launched from a water cannon.
Figure 3:
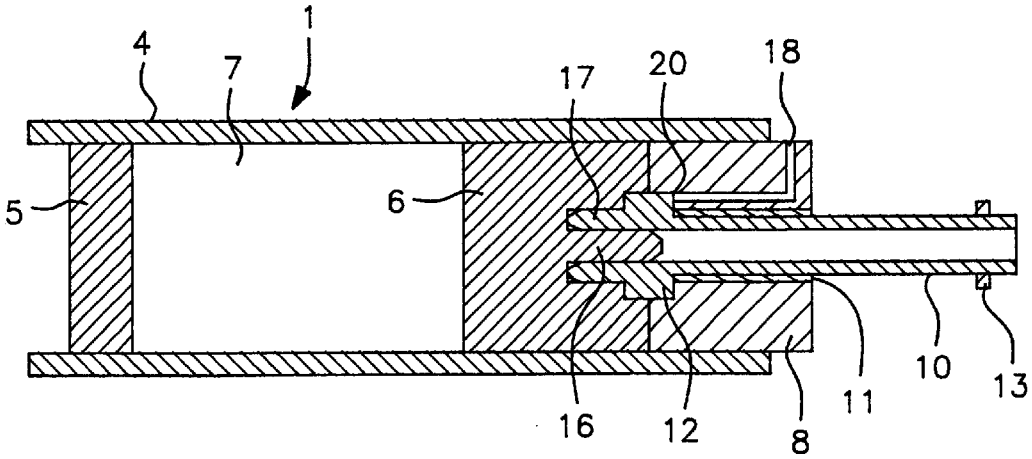
FIGS. 3–7 show in section a side view of a known water cannon which can be used for generating a mist according to the invention.
Figure 4:
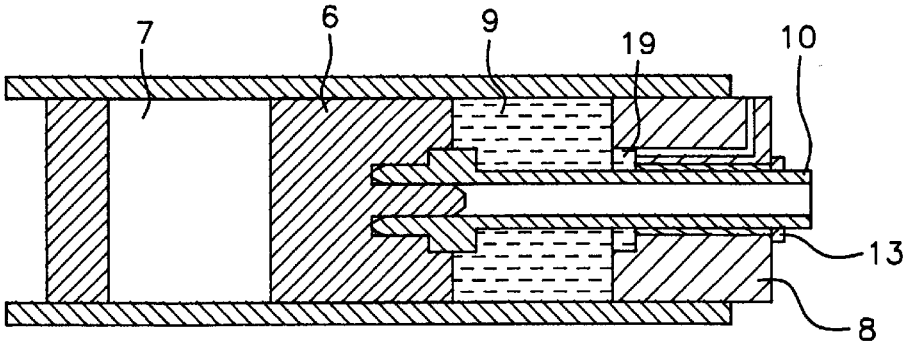
Figure 5:
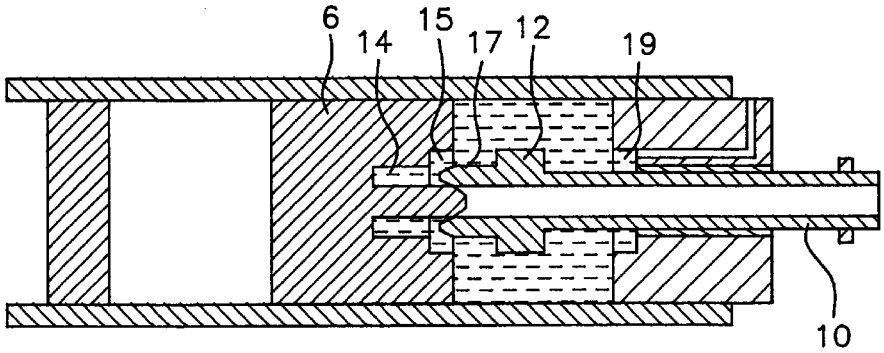
Figure 6:
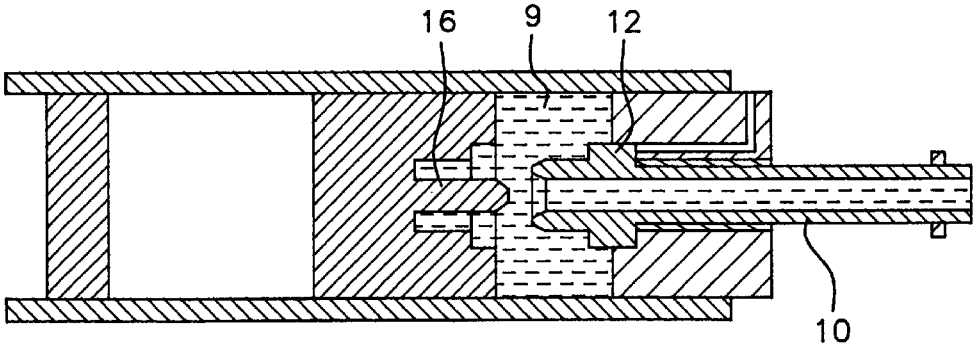
Figure 7:
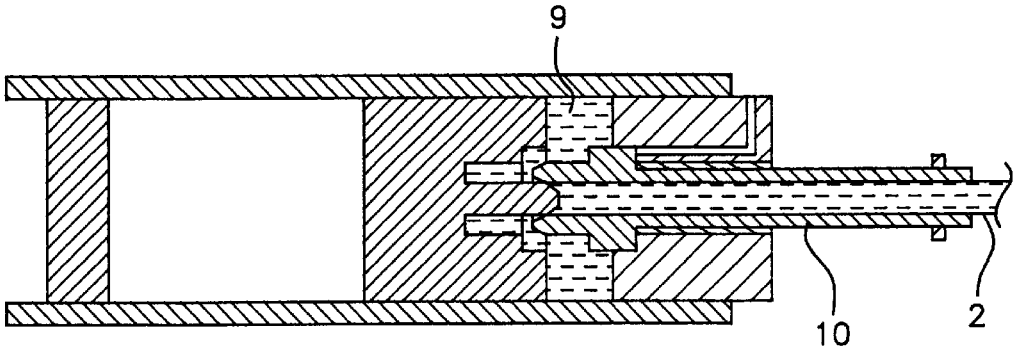

In the mist generation according to the invention, a water cannon 1 is utilized for launching an amount of liquid, for instance water. If the water is launched at a sufficiently high velocity a coherent water packet 2 is formed, which moves forward through the air, see FIG. 1. Under the effect of the air resistance, this water packet 2 will eventually decompose and atomize into small drops, whereupon a water mist 3 is formed, as can be seen in FIG. 2. By varying the launching velocity, it is possible to control how long distance the water packet 2 will travel before it decomposes. It is also possible to affect the cohesive characteristics of the water by means of different additives, and thus it is possible also in this way to control how long the packet of water will travel.

A water cannon 1 which can be used for performing the mist generation according to the method in question is shown in the Swedish patent application SE 8000632-3 A.

In FIGS. 3–7, an embodiment of this water cannon is shown. The cannon 1 comprises a cylinder 4 which at its rear end is closed by means of a back head 5. A drive piston 6 is reciprocable within the cylinder 4, and confines together with the back head 5 a rear cylinder chamber 7. A front head 8 is mounted in the forward end of the cylinder. The drive piston 6 and the front head 8 confine a forward cylinder chamber 9. An outlet pipe 10 is displaceably guided in a bushing 11 which is inserted in the front head 8. The movement of the pipe 10 is limited by a rear enlarged portion 12 and by a forward stop ring 13. The drive piston 6 is provided with an annular stepped recess 14, 15 at its forward end. This recess comprises an inner annular chamber 14 and an outer annular chamber 15, where the outer chamber 15 has a larger outer diameter than the inner chamber 14. The recess 14, 15 surrounds a central pin 16. The rear pipe portion 17 and the enlarged portion 12 can be pushed into the recess 14, 15. Liquid is supplied to the forward cylinder chamber 9 through a channel 18 which via a hose is connected to a high pressure pump for the liquid. The forward cylinder chamber 9 is provided with an annular chamber 19, which works as a retard chamber for the enlarged portion 12 so that the outlet pipe 10 is retarded hydraulically during the end of its movement forwards. The rear cylinder chamber 7 is charged with compressed gas. This gas acts upon the drive piston 6 which transmits the thrust load to the liquid in the forward cylinder chamber 9.

The cannon 1 operates as follows. The pump is started, whereupon the liquid is fed to the channel 18. The fluid pressure acts upon an annular surface 20 on the enlarged portion 12. The outlet pipe 10 and the drive piston 6 are then forced backwards against the action of the gas spring in the rear cylinder chamber 7. After a short displacement the fluid pressure also acts directly upon the drive piston 6. The drive piston 6 is pushed backwards together with the outlet pipe 10 and compresses the gas in the rear cylinder chamber 7. When the stop ring 13 is retarded against the front head 8, see FIG. 4, the pipe 10 is locked against a continued backward movement, whereupon the drive piston 6 alone is pushed further backwards. When the enlarged portion 12 leaves the outer chamber 15, liquid flows into this chamber. Shortly afterwards the rear portion 17 of the outlet pipe leaves the inner chamber 14, see FIG. 5, whereupon liquid also flows into this chamber. When the liquid is admitted into the inner chamber 14, the outlet pipe 10 is forced forwards. After a short movement of the outlet pipe 10, the pin 16 leaves the bore of the pipe, see FIG. 6. The outlet pipe 10 is rapidly driven forwards and is retarded when the enlarged portion 12 reaches the retard chamber 19. The liquid is forced outwards through the outlet pipe 10 by the thrust load acting upon the liquid in the forward cylinder chamber 9. In the outlet pipe 10 the liquid is formed as an oblong liquid packet 2 which is accelerated as a coherent mass body and launched into the air at a velocity of several hundred meters per second.

Further details concerning the construction and the functioning of the water cannon can be seen from SE 8000632-3 A.

A water cannon which is based on the embodiment described above has previously been manufactured by Atlas Copco under the name of "CRAC 200". It has turned out that when firing a shot into the air with this water cannon, a water packet is obtained, which initially is held together as an oblong body and which after a distance of about ten meters decomposes and atomises into a mist. This water cannon can launch water packets at intervals of about 8 seconds. By launching several water packets in rapid succession a mist can be maintained over a longer period of time and larger areas can also be covered.

Other types of water cannons which can launch water packets at a high enough velocity can also be used for generating a mist according to the invention. In addition to water other liquids can also be used. The liquid can be provided with an additive of substances which affect the absorption properties of the mist, for instance an insoluble substance in pulverised form or a soluble substance such as salt.

A water cannon intended to be used for generating a mist according to the method in question can for instance be mounted on the same gun-carriage as an anti-air-craft gun, whereupon available aiming devices can be used. It can also be mounted on a combat vehicle or a ship for protection against terminally guided missiles.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A method of generating a liquid mist for producing phantom targets, the method comprising the step of launching liquid with a water cannon at a high velocity and initially the liquid is held together in a liquid packet to decompose after a certain distance, under air resistance, and atomize into small liquid drops to form said liquid mist.

2. The method according to claim 1, wherein several liquid packets are launched consecutively in order to maintain said liquid mist over a period of time.

3. The method according to claim 1, wherein a substance which affects absorption properties of said liquid mist is added to said liquid before launching.

4. The method according to claim 1, wherein a substance which affects cohesive characteristics of said liquid is added to said liquid before launching.

5. A method of generating a liquid mist to produce camouflage, the method comprising the steps of:

launching liquid with a water cannon at a high velocity with said liquid being held together initially as a liquid packet; and permitting said liquid packet to decompose after a certain distance and said liquid to atomize into small liquid drops to form said liquid mist.

6. The method according to claim 5, wherein said liquid packet decomposes under air resistance.

7. The method according to claim 5, wherein several liquid packets are launched consecutively in order to maintain said liquid mist over a period of time.

8. The method according to claim 5, wherein a substance affecting absorption properties of said liquid mist is added before launching.

9. The method according to claim 5, wherein a substance affecting cohesive characteristics of said liquid is added before launching.

10. A method of generating a liquid mist to produce phantom targets, the method comprising the steps of:

launching liquid with a water cannon at a high velocity with said liquid being held together initially as a liquid packet; and permitting said liquid packet to decompose after a certain distance and said liquid to atomize into small liquid drops to form said liquid mist.

11. The method according to claim 10, wherein said liquid packet decomposes under air resistance.

12. The method according to claim 10, further comprising the step of consecutively launching in order several liquid packets for maintaining said liquid mist over a period of time.

13. The method according to claim 10, further comprising the step of adding to said liquid before launching a substance for affecting absorption properties of said liquid mist.

14. The method according to claim 10, further comprising the step of adding to said liquid before launching a substance for affecting cohesive properties of said liquid mist.

* * * * *